United States Patent [19]

Riley

[11] 4,441,294

[45] Apr. 10, 1984

[54] SUPPORT FOR ROOF INSULATION IN METAL BUILDINGS AND METHOD FOR INSULATING THE ROOF OF SUCH BUILDINGS

[76] Inventor: Robert E. Riley, 5110 Hammersley Rd., Madison, Wis. 53711

[21] Appl. No.: 385,510

[22] Filed: Jun. 7, 1982

[51] Int. Cl.[3] ..... E04B 2/28

[52] U.S. Cl. ..... 52/404; 52/662; 52/664; 52/508

[58] Field of Search ..... 52/404–408, 52/695, 489, 478, 660, 664, 665, 662, 508

[56] References Cited

U.S. PATENT DOCUMENTS

| | | | |
|---|---|---|---|
| 1,574,329 | 2/1926 | White | 52/695 |
| 4,147,003 | 4/1979 | Alderman | 52/404 |
| 4,263,763 | 4/1981 | Bouwens | 52/489 |
| 4,303,713 | 12/1981 | Clemensen et al. | 52/404 |
| 4,375,741 | 3/1983 | Paliwoda | 52/407 |
| 4,379,381 | 4/1983 | Holcombe | 52/404 |

FOREIGN PATENT DOCUMENTS

| | | | |
|---|---|---|---|
| 633391 | 2/1962 | Italy | 52/478 |

*Primary Examiner*—James L. Ridgill, Jr.

*Attorney, Agent, or Firm*—Isaksen, Lathrop, Esch, Hart & Clark

[57] ABSTRACT

A support grid (10) for roof insulation in a metal building having a roof (12) with a plurality of substantially identical, spaced purlins (16). The support grid includes at least one cross member (26) adapted to extend between adjacent purlins (16). The cross member (26) rests on and is supported by a flange (22, 24) of a first purlin (16) and the upper flange (22) of the adjacent purlin (16). At least one support member (46) may extend longitudinally at angles to the cross members (26) and be engaged therewith. Preferably a first end (30) of the cross member (26) is adapted to rest on the lower flange (24) of a first purlin (16), and a second end (32) is adapted to be hooked, prior to the application of rigid roofing material (18) to the purlins, over the upper flange (22) of the adjacent purlin (16) toward which the lower flange (24) of the first purlin (16) extends. The method for insulating of the invention includes installing a support grid (10) on the purlins (16) of a roof (12) from above before the purlins (16) are covered by other parts of the roof (12). Selected insulation material (34) is then placed onto the support grid (10) from above to substantially fill the space between the purlins (16) to a selected level. Then rigid roofing material (18) is fastened to the purlins (16) over the insulation material (34).

8 Claims, 6 Drawing Figures

SUPPORT FOR ROOF INSULATION IN METAL BUILDINGS AND METHOD FOR INSULATING THE ROOF OF SUCH BUILDINGS

TECHNICAL FIELD

The present invention relates to supports for roof insulation in metal buildings, and particularly to supports upon which insulation may be applied from above, before roof sheets are installed on the roof.

BACKGROUND ART

The art is cognizant of applying insulation for the roof of a metal building from above, before the roof sheets are installed. Alderman, U.S. Pat. No. 4,147,003, shows the placing of insulation in a trough of flexible sheet material formed between adjacent purlins of the roof and supported by a lattice of support straps, including support straps that extend between the purlins and through holes previously created in the purlins, or rest on rafters supporting the purlins. Alderman also shows the placement of insulating material over the tops of the purlins before the roof sheets are fastened to them. Related patents to Alderman include U.S. Pat. Nos. 3,559,914; 3,969,863; 4,047,345; 4,047,346; and 4,075,807. Wells, U.S. Pat. No. 4,117,641, shows clips adapted to be hooked to the lower stiffener members of purlins having a "C" or "Z" cross-sectional configuration. In Wells, an insulating board is engaged in the clip attached to one purlin and extends therefrom to an adjacent purlin to rest on the lower flange of the adjacent purlin. The clip and insulating board arrangement is applied to the purlins from beneath by a worker on scaffolding or the like. Bats of insulation may be carried on the board and held between the board and the roof sheet above.

Interlante, U.S. Pat. No. 4,251,972, shows a panel support merber adapted for use in buildings having roofs supported by purlins. The panel support members extend from the lower flange of a "Z" configuration purlin under the adjacent purlin, to hook back up and over the lower flange of that adjacent purlin. The panel support members again are adapted to be installed from beneath the purlins after the roof sheets are in place.

The art is not cognizant of means for installing a support for insulation from above without the need to modify purlins or other roofing support members so that insulation may be conveniently installed while the roof is being constructed and without the need to erect scaffolding or to subject workers to the discomfort and health hazards of attempting to deal with insulation directly above them as they work on the underside of a roof.

BRIEF SUMMARY OF THE INVENTION

The present invention is summarized in that a support grid for roof insulation in a metal building having a roof with a plurality of substantially identical, spaced Purlins, each purlin having a substantially vertical web and upper and lower flanges extending laterally from the web, includes at least one cross member adapted to extend transversely between adjacent spaced purlins to rest on and be supported by a flange of a first purlin and the upper flange of the adjacent purlin. At least one support member may extend longitudinally at angles to the cross members and be engaged therewith. The support grid is adapted to be lowered onto the purlins from above during construction of the building and is further adapted to receive and support insulation material within the space between the supporting purlins in selected proximity to rigid roofing material applied over the purlin upper flanges.

A primary object of the invention is to provide a means for supporting roof insulation in a metal building that may be conveniently and efficiently installed from above, before rigid roofing material is applied to the roof of a building.

A second object of the invention is to supply a support for roof insulation that may be installed without the necessity of forming holes or even of aligning preformed holes in purlins.

Another object of the invention is to provide a support grid for roof insulation having sufficient rigidity that it may be placed in desired supporting position by a worker standing on the roof beams that support the purlins of the roof without requiring the worker to attempt to walk out onto the purlins themselves, thereby increasing the safety and convenience with which the worker can accomplish this task.

A further object of the invention is to provide a support for roof insulation having cross members that extend between the purlins of the roof with selected rigidity but that have a hook at one end adapted to hook over one of the purlins with sufficient flexibility to conveniently allow the worker who is installing the cross member to position it on the purlins.

Yet another object of the invention is to provide a method for insulating the roof of a metal building conveniently and efficiently from above before the installation of rigid roofing material over the purlins of the roof.

Yet another object of the invention is to provide convenient means for thermally isolating the rigid roofing material of a metal building from the supporting purlins.

A further object of the invention is to provide a roof structure adapted to be insulated and conveniently constructed so that the insulation is supported between the purlins of the roof structure by support grids that may be installed from above before rigid roofing material is fastened to the purlins.

Other objects, features, and advantages of the invention will be apparent from the following detailed description taken in conjunction with the accompanying drawings showing a preferred embodiment of a support grid for roof insulation exemplifying the principles of the invention.

DETAILED DESCRIPTION OF THE PREFERRED EMBODIMENT

Figure 1:
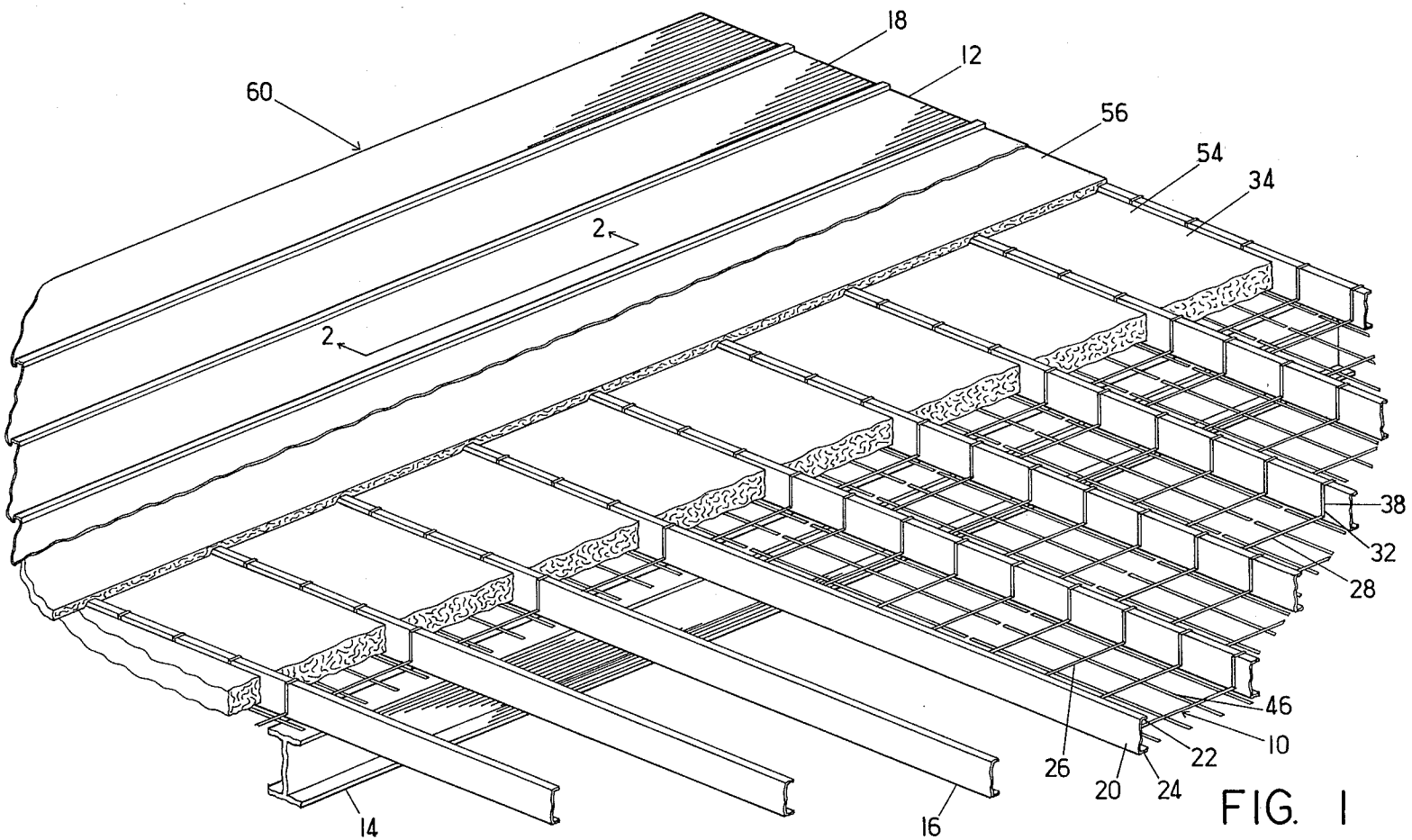
FIG. 1 is a perspective view of the roof of a metal building with parts of the roof sheeting and insulation cut away.

Referring more particularly to the drawings, wherein like numbers refer to like parts, FIG. 1 shows a support grid for roof insulation in a metal building, generally indicated at 10, constructed in accord with the present invention. The support grid 10 is shown installed in a roof 12. The roof 12 includes roof beams 14, which support a plurality of substantially identical, spaced purlins 16. The purlins 16 support rigid roofing material 18. Conventionally, the rigid roofing material 18 is metal roof sheeting attached to the purlins 16 by screws, rivets, or other convenient means for attachment (not shown).

Figure 2:
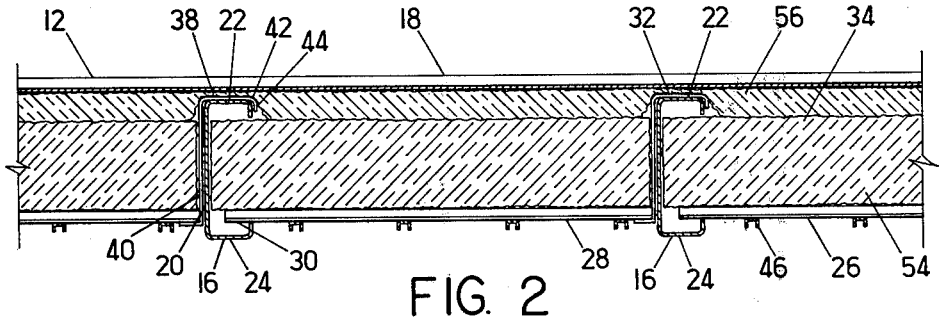
FIG. 2 is a cross-sectional view of a portion of the roof shown in FIG. 1 taken along section lines 2—2.
Figure 3:
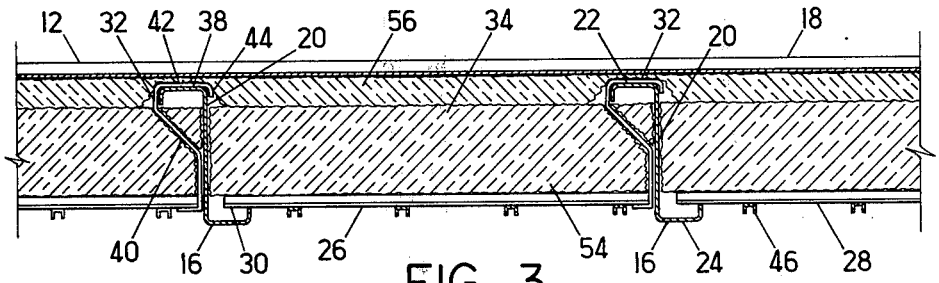
FIG. 3 is a cross-sectional view analogous to that of FIG. 2 of a roof constructed with "Z" purlins, showing an alternative embodiment of the cross members of the invention.

Each purling 16 has a substantially vertical web 20. Upper and lower flanges 22 and 24 extend laterally from the web 20. Conventionally, purlins used in the construction of building roofs have either a "C" cross-sectional configuration in which both upper and lower flanges 22 and 24 extend laterally from the web to the same side, as is shown in FIG. 2, or a "Z" cross-sectional configuration, in which the upper flange and lower flange extend laterally from the web on opposite sides thereof, as is shown in FIG. 3.

The preferred embodiment of the support grid 10 of the invention has several, parallel cross members 26 spaced a convenient distance apart. Parallel support members 46 are rigidly fastened at spaced intervals to the cross members 26, preferably at right angles thereto, to form a substantially rigid, light weight support grid 10. The cross members 26 are adapted to extend transversely between adjacent spaced purlins 16 to be supported by upper surfaces of the purlins. Typically, such purlins are spaced at 5-foot intervals, or the like, and the roof beams 14 that support them may be separated by, for example, 24 feet. Thus, a worker can conveniently pick up a support grid 10 and drop it into place on the purlins 16 from above to provide support for roof insulation extending from purlin to purlin and for the length of the grid. It is convenient to make the support grids 10 in a length equal to and half the distance between roof beams 14, so that a worker may stand on a roof beam to drop the support grid into place on the purlins 16, pushing it toward the adjacent roof beam to extend half way thereto. A second support grid 10 can then be installed from the adjacent roof beam 14, allowing the worker to provide support for insulation extending from beam to beam in two simple operations. Furthermore, because roof beams 14 are generally larger and more rigid than purlins 16, providing a safer and more convenient footing for the worker, the ability to prepare the entire space between roof beams for the support of insulation without the need to walk on purlins represents a safety advantage.

Each cross member has a bar 28 extending for substantially the distance between adjacent purlins 16. A first end 30 of each cross member 26 is adapted to rest on a flange 22, 24 of a first purlin 16, and a second end 32 of the cross member is adapted to be hooked, prior to the application of rigid roofing material, over the upper flange 22 of the adjacent purlins 16. Preferably, the first end rests on the lower flange 24 of the first purlin 16, and the second end hooks over the upper flange 22 of the adjacent purlin 16 towards which the lower flange of the first purlin extends. Thus, the first ends 30 of a support grid 10 may be put in place on the flange of the first purlin 16 from above the purlins during the construction of the building. The second ends 32 may then be lowered onto the adjacent purlin 16 from above to rest thereon in supporting relation. Thus in place, the support grids 10 are adapted to receive and support insulation, which may be lowered onto the grids from above after they have been placed on the purlins 16 to be supported thereby within the space between the supporting purlins.

It is desirable for the bar 28 of the cross members 26 to extend substantially parallel to the roof 12 and be located beneath the rigid roofing material 18 at a distance approximately equal to or slightly greater than the thickness of the insulation 34 to be supported thereby. When, as is preferred, the first ends 30 of the cross members 26 are placed on the lower flange 24 of a purlin 16, and when the distance between the upper and lower flanges 22, 24 of the purlins 16 exceeds the thickness of the insulation 34 to be supported, it is convenient to elevate to a selected extent the bars 28 of the cross members 26 above the lower flange 24 upon which the first ends 30 rest. Preferably the first end 30 of each cross member 26 includes a foot 36 that extends downwardly from the bar 28 for a selected distance. The foot 36 is adapted to rest on the lower flange 24 of the first purlin 16 and to thus elevate the bar 28 thereabove and toward the rigid roofing material 18 to a selected extent.

Preferably the second ends 32 of the cross members 26 include hooks 38 adapted to rest on the upper flange 22 of a purlin 16 when the cross members 26 are installed. Each hook 38 has a suspension portion 40 that extends upwardly from the bar 28 for a distance selected to be at least as great as the depth of insulation 34 to be supported. A holding portion 42 of the hook 38 extends from the suspension portion 40 for a selected distance away from the first end 30 of the cross member 26, oriented substantially parallel to the bar 28. Thus, after the first end 30 is placed on the lower flange 24 of a purlin 16, the second end may be lowered from above over the upper flange 22 of the adjacent purlin 16 toward which the lower flange 24 of the first purlin extends until the holding portion 42 rests on the upper flange 22 to be supported thereby. The bar 28 will then be supported beneath the level of the upper flange 22 to which the rigid roofing material 18 will eventually be attached at a distance sufficient to accommodate the thickness of insulation 34 that is to be supported by the bar.

Preferably the holding portion 42 of the hook 38 is substantially as long as the width of the upper flange 22 of the purlins. The hook 38 may then include a retention tab 44 extending downwardly from the end of the holding portion 42 remote from the suspension portion 40. Thus the upper flange 22 on which the holding portion 42 rests may be embracingly engaged by the suspension portion 40, holding portion 42, and retention tab 44 of the hook 38 to prevent any substantial movement of the cross member 26 in a direction transverse to the flange. The retention tabs 44 of the cross members 26 of a support grid 10 also aid in controlling the grid when a worker standing on a roof beam 14 slides the grid on the purlins 16 toward an adjacent roof beam. In such an operation, the tabs 44 prevent the support grid 10 from slipping off and falling between the supporting purlins 16.

It will be appreciated that it is desirable that the insulation 34 extend between the purlins 16 with as few obstructions as possible. Specifically, it is desirable that the suspension portion 40 of the hook 38 be in close proximity to the vertical web 20 of the purlins so as to interfere to the least extent possible with the insulation as it spans the distance between adjacent purlins. When the purlins have a "C" configuration, the bar 28 may be adapted to extend entirely to the web of the purlin 16 supporting the second end 32 of the cross member 26, as is shown in FIG. 2. The suspension portion 40 of the hook 38 may then extend upwardly from the bar 28 in close proximity to or even in contact with the web 20. If the hook 38 incorporates a retention tab 44, the suspension portion 40 can be reliably held against the web 20 to provide the least possible interference with the insulation 34.

When the purlins 16 have a "Z" cross-sectional configuration the bar 28 preferably still is adapted to extend substantially to the web 20 of the purlin 16 that supports the second end 32 of the cross member 26. The suspension portion 40 of the hook 38 preferably extends upwardly from the bar 28 for a selected distance parallel to the web 20. For this distance, the insulation 34 supported by the cross member 26 is as unobstructed in its contact with the web 20 as if a purlin with a "C" cross-secional configuration were in use. After so extending upwardly for a selected distance, the suspension portion 40 then extends away from the web 20 at a selected angle thereto until the suspension portion extends under and beyond the furthest lateral extension of the upper flange 22 of the purlins 16, then extending upwardly to a distance from the bar 28 selected to be at least as great as the depth of insulation 34 to be supported.

In certain instances, a support grid 10 may include only one cross member 26 and no support members 46. A selected number of such cross members 26 may extend between adjacent purlins 16 in the manner disclosed above and will be sufficient in themselves to support insulation 34 of a given stiffness. Thus, styrofoam sheets and comparable substantially rigid materials may be supported by the cross members 26. Such rigid insulating material may then in turn support shredded insulation materials or the like. Alternatively, the insulation 34 supported by the cross members 26 may be insulating batting, as is shown in FIGS. 1–4. Such batting is available in conventional forms, either with or without a vapor barrier attached thereto, and has a certain amount of rigidity in itself. Thus, when a sufficient number of cross members 26 are placed on the purlins 16, such insulating batting, either with or without a vapor barrier, may be installed on the cross members from above and be supported thereby.

However, as is disclosed in general terms above, the preferred embodiment of the support grid 10 of the invention includes at least one and preferably a plurality of support members 46 extending longitudinally between a plurality of cross members 26 at angles to the cross members and engaged therewith. As increasing numbers of such support members 46 are employed, cross members 26 may be more widely spaced from each other with the resulting support grid 10 providing adequate support for the insulation 34.

As is disclosed above, it is preferred that the support members 46 be rigidly attached to the cross members 26 to create a support grid 10 of a selected length and width that may be handled by workers as a substantially rigid unit. However, the support members 46 may be attached to the cross members 26 in pivoting relation or may even be placed on top of the bars 28 of the cross members and not be fastened thereto.

The support grid 10 of the invention may be made of any convenient and suitably rigid material. Preferably the bars 28 of the cross members 26 are made out of channel material, such as conventional angle iron, "U" channel or the preferred conventional hat cross-section channel material shown in cross section in FIG. 5. Such hat cross-section channel material has a body portion 48 having an inverted "U" shape and side flanges 50 extending outwardly and laterally from the bottom of the body portion 48 for a selected distance. Preferably support members 46 are also made of channel material, such as the U-channel members shown in cross section in FIGS. 2, 3, and 4, in which the channel material has a cross-sectional shape similar to an inverted U. When it is desired to rigidly fasten the support members 46 to the bar 28, rivets or other conventional fasteners, such as the screws 52 shown in FIG. 5 may be extended through the side flanges 50 of the bars 28 and directly into the support members 46.

Figure 4:
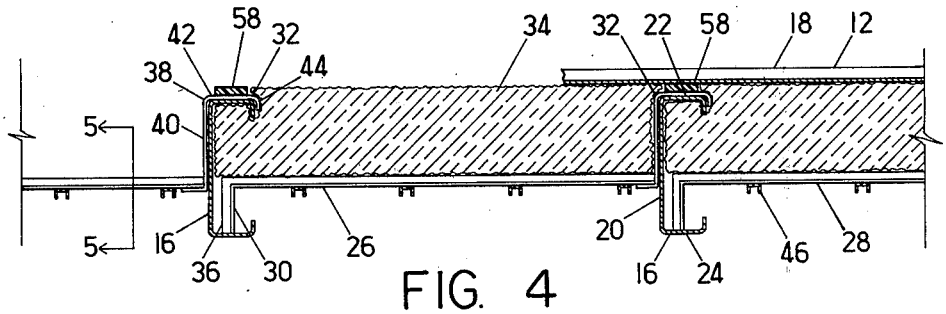
FIG. 4 is a cross-sectional view analogous to that of FIG. 2 showing an alternative embodiment of the cross members of the invention.
Figure 5:
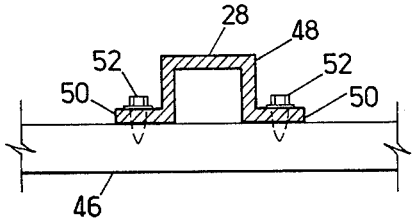
FIG. 5 is a cross-sectional view of the bar of a cross member taken along section lines 5—5 of FIG. 4.
Figure 6:
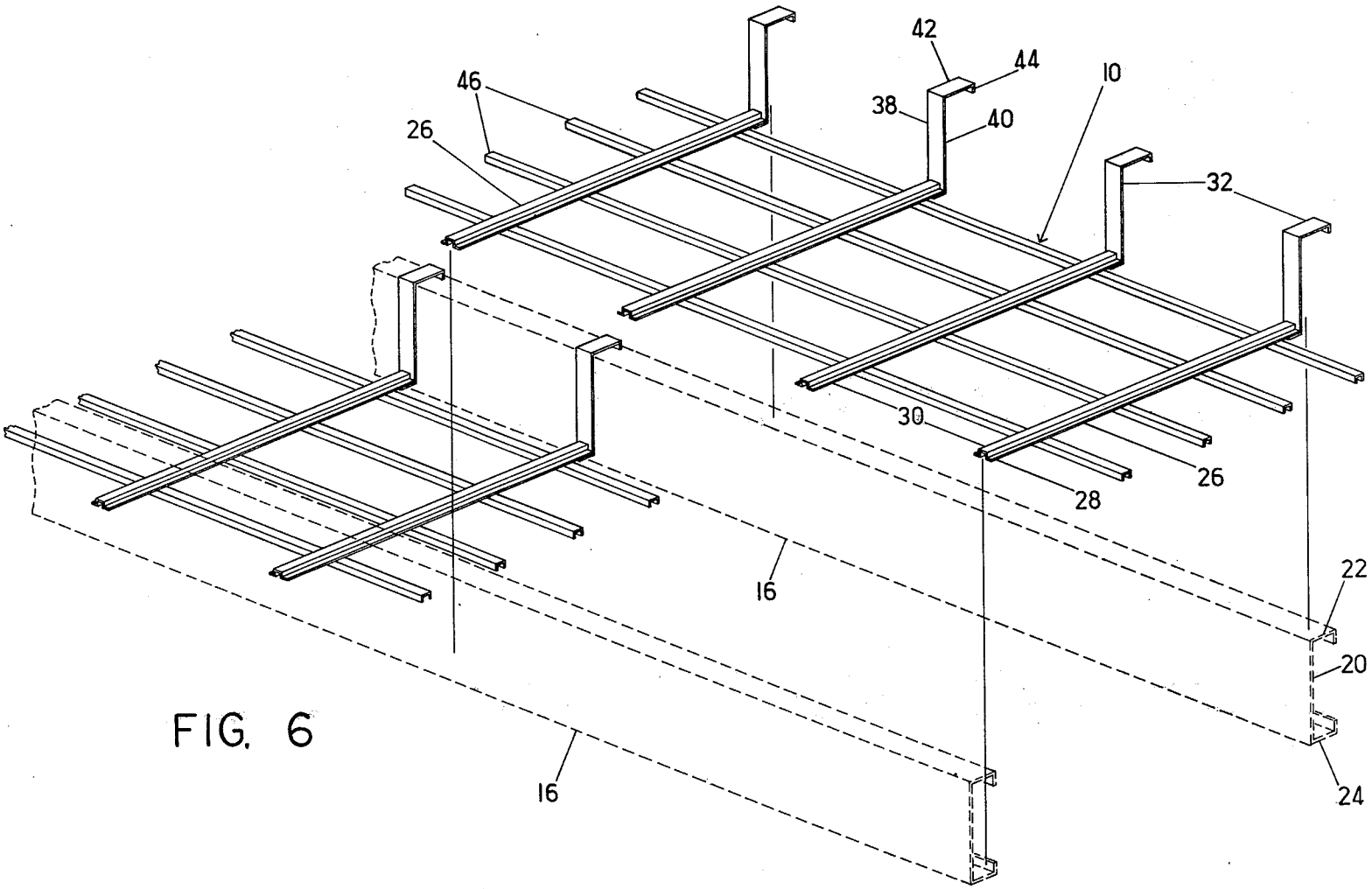
FIG. 6 is a perspective view of the preferred embodiment of the support grid of the invention, positioned above purlins shown in phantom.

It is convenient and desirable to manufacture the hook 38 of the cross members 26 out of a flat, resiliently flexible material of selected strength rigidly fastened to the bar 28 by any suitable and conventional mode of fastening, such as spot welding or screws. Preferably the hook 38 is fastened to the under side of the bar 28, as is shown in FIGS. 2–4. The resulting hook 38 thus has a selected flexibility that facilitates the placement of the hook over a purlin 16 while the rigidity of the bar 28 is maintained.

The cross members 26 may be made of relatively narrow material, as disclosed above, but also may be made out of relatively wide material, such as expanded metal mesh or rigid plastic sheet material, with or without perforations. When the cross members 26 are made of such materials, they may be allowed to have any selected width including, for example, a width coextensive with the entire support grid 10. In such an event, the support grid 10 could be made of an essentially unitary piece of material of either uniform thickness or with such embossings or molded-in thicker portions as might be deemed convenient or necessary to strengthen the cross member 26. These and comparable modified forms of the structures disclosed above all come within the scope and spirit of the invention.

It will be appreciated that both the preferred embodiment of the invention shown at 10 and the modified forms discussed above are substantially flat structures that may be conveniently stacked. Thus, it is possible to essemble the support grids 10 at a factory where manufacturing can be efficiently accomplished. The grids 10 can then be stacked for efficient shipping. Large stacks of grids 10 may be lifted in and out of trucks with cranes and be similarly placed on top of the purlins 16 of a roof 12 under construction. Workers may then take individual support grids 10 from the stacks and drop them into place on the purlins 16, standing on the roof beams 14 in the manner discussed above. Because no essembly of support grids 10 at the building site is necessary, and because when each grid is dropped into place a large area of the roof 12 is prepared for insulation, a roof may be quickly insulated with an efficient use of a minimal amount of on site labor.

The method of the invention for insulating the roof 12 of a metal building includes dropping the above disclosed support grids 10 in place on the purlins 16 from above before the purlins are covered by other parts of the roof structure. As disclosed above, the support grids 10 are adapted to receive and support insulation within the space between the supporting purlins 16 and beneath the rigid roofing material 18.

With the support grids in place, a selected insulation material 34 is placed onto the support grid 10 from above to substantially fill the space between the purlins 16 to a selected level. Preferably, the step of placing a selected insulation material onto the support grid from above includes first placing lengthwise relative to the purlins 16 a first layer 54 of insulation batting having a width substantially equal to the distance between adjacent purlins. The thickness of the first layer 54 is selected to be less than the total thickness of insulation desired. Then a second layer 56 of insulation batting is placed transverse to the purlins 16, the second layer 56 extending over the purlins and covering the first layer 54 of insulation batting. The second layer 56 of insulation batting has a selected thickness such that the thickness of the first layer 54 added to that of the second layer 56 is the desired thickness of insulation. By this means, when the rigid roofing material 18 is fastened to the purlins 16 over the insulation material 34, a portion of the second layer 56 of insulation batting is interposed between the rigid roofing material and the purlins, interrupting the direct flow of heat between the rigid roofing material and the purlins. Alternatively, the method the invention may include the step of placing a substantially incompressible thermal break 58 over the upper flanges 22 of the purlins 16 before attaching the rigid roofing material 18 thereto. The thermal break 58 is preferably a strip of styrofoam or other comparable insulating material. The presence of the thermal break 58 serves to interrupt the direct flow of heat between the rigid roofing material 18 and the purlins 16.

The roof structure of the invention, shown generally at 60 in FIG. 1 includes a plurality of substantially identical, spaced purlins 16 supported by roof beams 14, as described above. The roof structure 60 further includes support grids 10 having the structure disclosed above. Insulation material 34 is supported by the support grids 10 to substantially fill the space between the purlins 16 to a selected depth. Rigid roofing materials 18 are fasted to the purlins 16 from above over the support grids 10 and insulation material 34. Preferably, the insulation material 34 includes a first layer 54 of insulation batting extending substantially between adjacent purlins 16 and a second layer 56 of insulation batting extending transversely over the purlins and covering the first layer of insulation batting. Alternatively, the roof structure 60 may include a thermal break 58 having the structure disclosed above substantially covering the upper flanges 22 of the purlins 16 and interposed between the purlins and the rigid roofing material 18.

It is understood that the present invention is not limited to the particular construction and arrangement of parts illustrated and disclosed, nor to the materials specified, nor to the particular steps disclosed herein. Instead, it embraces all such modified forms thereof as come within the scope of the following claims.

What is claimed is:

1. A support grid (10) in a roof insulation in a metal building having a roof (12) with rigid roofing material (18) fastened on top of spaced, substantially identical purlins (16), each purlin (16) having a substantially vertical web (20), an upper flange (22) extending laterally therefrom, and a lower flange (24) extending laterally therefrom and toward an adjacent purling (16), comprising:

(a) a plurality of cross members (26) adapted to extend transversely between adjacent spaced purlins (16), each cross member (26) having a bar (28) extending for substantially the distance between adjacent purlins (16), a first end (30) adapted to rest on the lower flange (24) of a first purlin (16), and a second end (32) adapted to be hooked, prior to the application of the rigid roofing material (18), over the upper flange (22) of the adjacent purlin (16) toward which the lower flange (24) of the first purlin (16) extends, the second end (32) of the cross member (26) including a hook (38) having a suspension portion (40) that extends upwardly from the bar (28) for a distance selected to be at least as great as the depth of insulation material (34) to be supported and a holding portion (42) extending from the end of the suspension portion (40) remote from the bar (28) substantially parallel to the bar (28) for a selected distance away from the first end (30) of the cross member (26), the holding portion (42) of the hook (38) adapted to rest on top of the upper flange (22) of said adjacent purlin (16) in supporting relation; and (b) a selected number of support members (46) extending longitudinally at angles to the cross members (26) and rigidly engaged therewith, whereby the support grid (10) may be dropped easily into place on the purlins (16) as a pre-assembled unit from above prior to application of the rigid roofing material (18) the rigid engagement of the support members (46) to the cross members (26) causing the support grid (10) to be fixed in position without the need for fastening to the purlin so as to receive and support insulation material (34) within the space between the supporting purlins (16) in selected proximity to the rigid roofing material (18), support grid allowing insulation to fill the space entirely from the vertical web of one purlin to the vertical web of the adjacent purlin.

2. The support grid (10) specified in claim 1 wherein the bars (28) of the cross members (26) are made out of channel material, and wherein the hook (38) is made of a resilient material of a selected flexibility to facilitate the placement of the hook (38) over a purlin (16) while maintaining the rigidity of the bar (28).

3. The support for roof insulation (10) specified in claim 1 wherein the first end (30) of the cross members (26) includes a foot (36) that extends downwardly from the bar (28) for a selected distance to rest on the lower flange (24) of the first purlin (16) to elevate the bar (28) thereabove to a selected extent, whereby the distance between the bar (28) and the rigid roofing material (18) may be selected.

4. A roof structure (60) comprising:

(a) a plurality of substantially identical, spaced purlins (16) supported by roof beams (14), each purlin (16) having a web (20) and an upper flange (22) and lower flange (24) extending laterally from the web (20);

(b) support grips (10) having cross members (26) extending between adjacent purlins (16) to rest on and be supported by a lower flange (24) of a first purlin (16) and the upper flange (22) of an adjacent purlin (16) and support members (46) extending between the cross members (26) and fixedly secured thereto, the cross members (26) each including a bar (28) extending for substantially the distance between the purlins (16) and a hook (38) at one end of each bar (28), the hook (38) including a suspension portion (40) extending upwardly from the bar (28), a holding portion (42) extending therefrom a selected distance away from the suspension portion (40) and a retention tab (44) extending downwardly from the end of the holding portion (42) remote from the suspension portion (40), so that the unitary rigid support grid rests on the purlins with the end (30) of the cross members (26) remote from the hook (38) resting on the lower flange (24) of one purlin (16) while the hook (38) is received engaged over an adjacent purlin (16), the support grids (10) thus being adapted to be set in place on the purlins (26) from above and to rest on the purlins securely in position without the need of fastening to the purlins (16), (c) insulation material (34) supported by the support grids (10) to substantially fill the space between the purlins (16) to a selected depth substantially from the web (20) of each purlin (16) to the web (20) of each adjacent purlin (16);

(d) rigid roofing material (18) fastened to the purlins (16) from above over the support grids (10) and insulation material (34).

5. The roof structure (60) specified in claim 4 wherein the first end (30) of each cross member (26) includes a foot (36) that extends downwardly from the bar (28) for a selected distance to rest on the lower flange (24) of the first purlin (16) to elevate the bar (28) thereabove and toward the rigid roofing material (18) a selected distance.

6. The roof structure (60) specified in claim 4 wherein the purlins (16) have a "Z" cross section in which the lower flange (24) extends laterally from the web (20) in one direction and the upper flange (22) extends laterally from the web (20) in the opposite direction, and wherein the bar (28) extends substantially to the web (20) of the adjacent purlin (16), and the suspension portion (40) of the hook (38) extends upwardly from the bar (28) for a selected distance, first parallel to the web (20), then away therefrom at a selected angle thereto until the suspension portion (40) extends under and beyond the furthest lateral extension of the upper flange (22), and then upwardly to a distance from the bar (28) selected to be at least as great as the depth of insulation material (34) to be supported.

7. The roof structure (60) specified in claim 4 wherein a thermal break (58) rests on top of the upper flanges (22), under the rigid roofing material (18) attached thereto, to interrupt the direct flow of heat between the rigid roofing material (18) and the purlins (16).

8. The roof structure (60) specified in claim 4 wherein the insulation material (34) includes:

(a) a first layer (54) of insulation batting having a width substantially equal to the distance between adjacent purlins (16) and having a selected thickness less than the total thickness of insulation material (34) desired; and (b) a second layer (56) of insulation batting oriented transverse to and extending over the purlins (16) and covering the first layer (54) of insulation batting, the second layer (56) having a selected thickness such that the thickness of the first layer (54) added to the thickness of the second layer (56) is the desired thickness of insulation material (34).

* * * * *